US009260912B2

(12) United States Patent
Huang

(10) Patent No.: US 9,260,912 B2
(45) Date of Patent: Feb. 16, 2016

(54) CORD-WINDING DEVICE FOR A VENETIAN BLIND

(71) Applicant: Taicang Kingfu Plastic Manufacture Co., Ltd., Jiangshu Province (CN)

(72) Inventor: Szu-Chang Huang, Changhua County (TW)

(73) Assignee: Taicang Kingfu Plastic Manufacture Co., Ltd., Jiangshu Province (CN)

( * ) Notice: Subject to any disclaimer, the term of this patent is extended or adjusted under 35 U.S.C. 154(b) by 130 days.

(21) Appl. No.: 14/173,486

(22) Filed: Feb. 5, 2014

(65) Prior Publication Data

US 2014/0291431 A1 Oct. 2, 2014

(30) Foreign Application Priority Data

Mar. 26, 2013 (CN) ..... 2013 2 0141523 U

(51) Int. Cl.
*E06B 9/30* (2006.01)
*E06B 9/322* (2006.01)

(52) U.S. Cl.
CPC ..... *E06B 9/322* (2013.01); *E06B 2009/3225* (2013.01)

(58) Field of Classification Search
CPC .. E06B 9/322; E06B 9/325; E06B 2009/3222
USPC ..... 160/170, 171, 178.1 R, 173 R
See application file for complete search history.

(56) References Cited

U.S. PATENT DOCUMENTS

2006/0278348 A1* 12/2006 Huang ..... 160/170
2014/0083631 A1* 3/2014 Huang ..... 160/170
2014/0224431 A1* 8/2014 Lin ..... 160/84.01

* cited by examiner

*Primary Examiner* — Sang Kim
(74) *Attorney, Agent, or Firm* — Osha Liang LLP

(57) ABSTRACT

A cord-winding device for a Venetian blind includes: a first reel; a driving unit including a driving wheel and a spring-winding wheel; and a brake unit including a driven gear, a driving member, a ratchet wheel sleeved on the driving member, a plurality of friction members disposed between the driving member and the ratchet wheel, and at least pawl biased to engage the ratchet wheel. When the driven gear is driven by the first reel to rotate in a direction, rotation of the ratchet wheel is stopped by the pawl so that the driving member drives the friction members to rotate, and when the driven gear is driven by the driving wheel to rotate in an opposite direction, the driving member drives rotation of the friction members and, thus, the ratchet wheel.

13 Claims, 16 Drawing Sheets

CORD-WINDING DEVICE FOR A VENETIAN BLIND

CROSS-REFERENCE TO RELATED APPLICATION

This application claims priority of Chinese Application No. 201320141523.9, filed on Mar. 26, 2013.

BACKGROUND OF THE INVENTION

1. Field of the Invention

This invention relates to a Venetian blind, and more particularly to a cord-winding device for a Venetian blind having a brake unit and a pull cord unit that is not directly operated.

2. Description of the Related Art

Referring to FIGS. 1 and 2, a Venetian blind disclosed in Taiwanese Utility Model Patent Publication Number 363667 includes a head rail 1, a bottom rail 2, a plurality of slats 3, two pull cords 4, a winding unit 5, and a positioning unit 6. The winding unit 5 includes a casing 501 disposed within the bottom rail 2, two cord-winding members 502 disposed rotatably within the casing 501, and two spiral springs 503 connected between the cord-winding members 502 and the casing 501. Each of the cord-winding members 502 has a winding portion 504 permitting the corresponding pull cord 4 to be wound thereon, and a engaging portion 505 formed with continuous teeth. The positioning unit 6 includes a braking member 601 and a plurality of springs 602 disposed between and abutting against the casing 501 and the braking member 601. The braking member 601 has two rack portions 603 meshing with the engaging portions 505.

When it is desired to close the slats 3, the braking member 601 is pressed to remove the rack portions 603 from the engaging portions 505. At this time, if the bottom rail 2 is pushed upwardly, the pull cords 4 will be wound around the cord-winding members 502 by virtue of return force of the spiral springs 503, so that the slats 3 are superposed on the bottom rail 2. Conversely, if the bottom rail 2 is pulled downwardly, the pull cords 4 are unwound from the cord-winding members 502 so that the slats 3 are opened. When the bottom rail 2 is lowered to a desired height, the braking member 601 is released to allow the rack portions 603 to engage the engaging portions 505 to thereby stop rotation of the cord-winding members 502. In this manner, the bottom rail 2 can be maintained at any desired height.

As such, the positioning unit 6 is operable to control rotation of the cord-winding members 502. However, in actual use, since the winding unit 5 and the positioning unit 6 are disposed in a middle portion of the bottom rail 2, and since the user needs to press the braking member 601 and push upwardly or pull downwardly the bottom rail 2 with one hand, the bottom rail 2 cannot be held in a balance manner. As a result, the cord-winding members 502 cannot wind the pull cords 4 synchronously, so that the bottom rail 2 is apt to recline, thereby resulting in inconvenience during use and operation.

SUMMARY OF THE INVENTION

The object of this invention is to provide a cord-winding device for a Venetian blind, which is convenient to operate.

According to this invention, a cord-winding device for a Venetian blind includes: a first reel; a driving unit including a driving wheel and a spring-winding wheel; and a brake unit including a driven gear, a driving member, a ratchet wheel sleeved on the driving member, a plurality of friction members disposed between the driving member and the ratchet wheel, and at least one pawl biased to engage the ratchet wheel. When the driven gear is driven by the first reel to rotate in a direction, rotation of the ratchet wheel is stopped by the pawl so that the driving member drives the friction members to rotate, and when the driven gear is driven by the driving wheel to rotate in an opposite direction, the driving member drives rotation of the friction members and, thus, the ratchet wheel.

As such, the pull cords can be wound or unwound without operating directly the brake unit. That is, the cord-winding device is convenient to operate.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
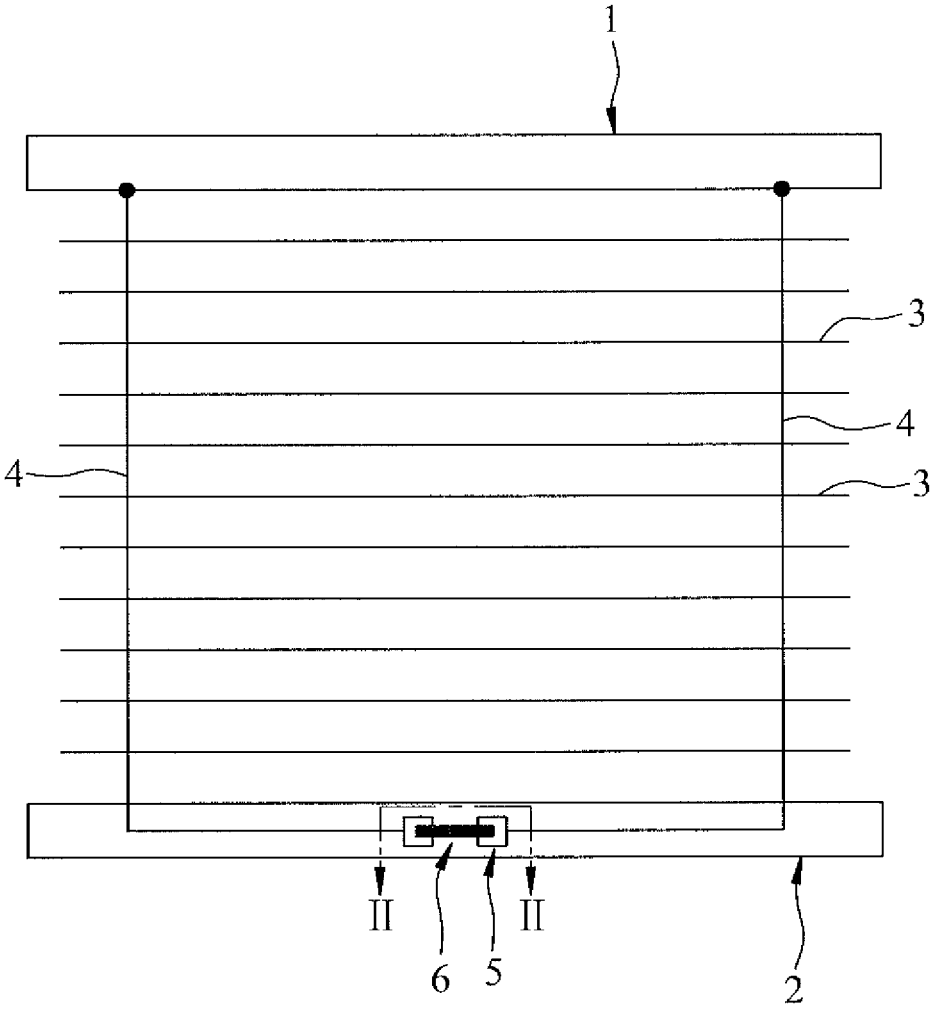
FIG.1 PRIOR ART
FIG. 1 is a schematic view of a conventional cord-winding device for a Venetian blind.
Figure 2:
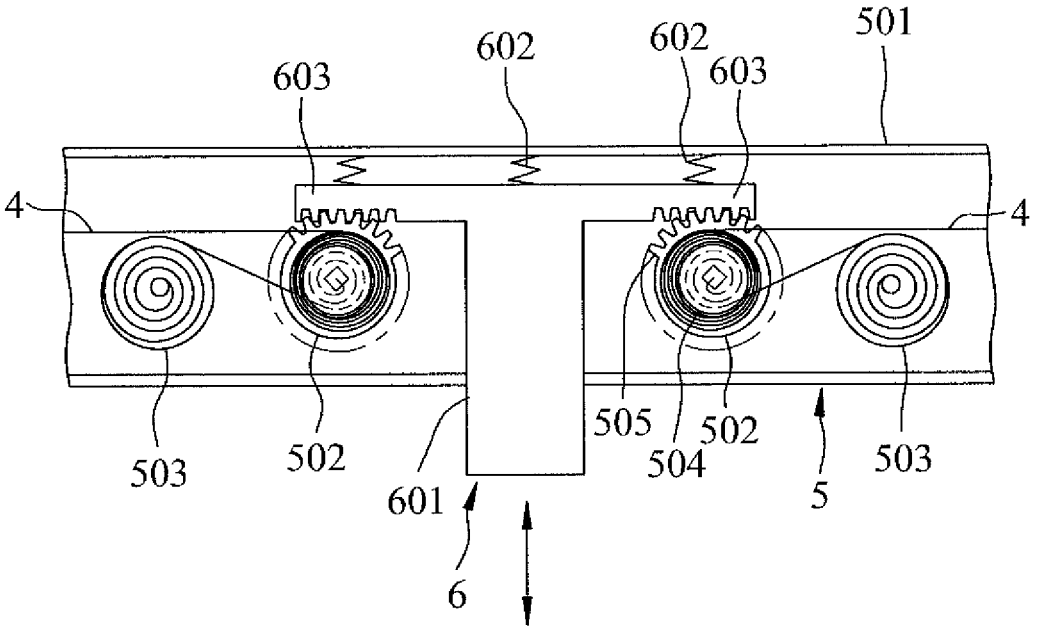
FIG.2 PRIOR ART
FIG. 2 is a sectional view taken along line II-II in FIG. 1.

Before the present invention is described in greater detail in connection with the preferred embodiments, it should be noted that similar elements and structures are designated by like reference numerals throughout the entire disclosure.

Figure 3:
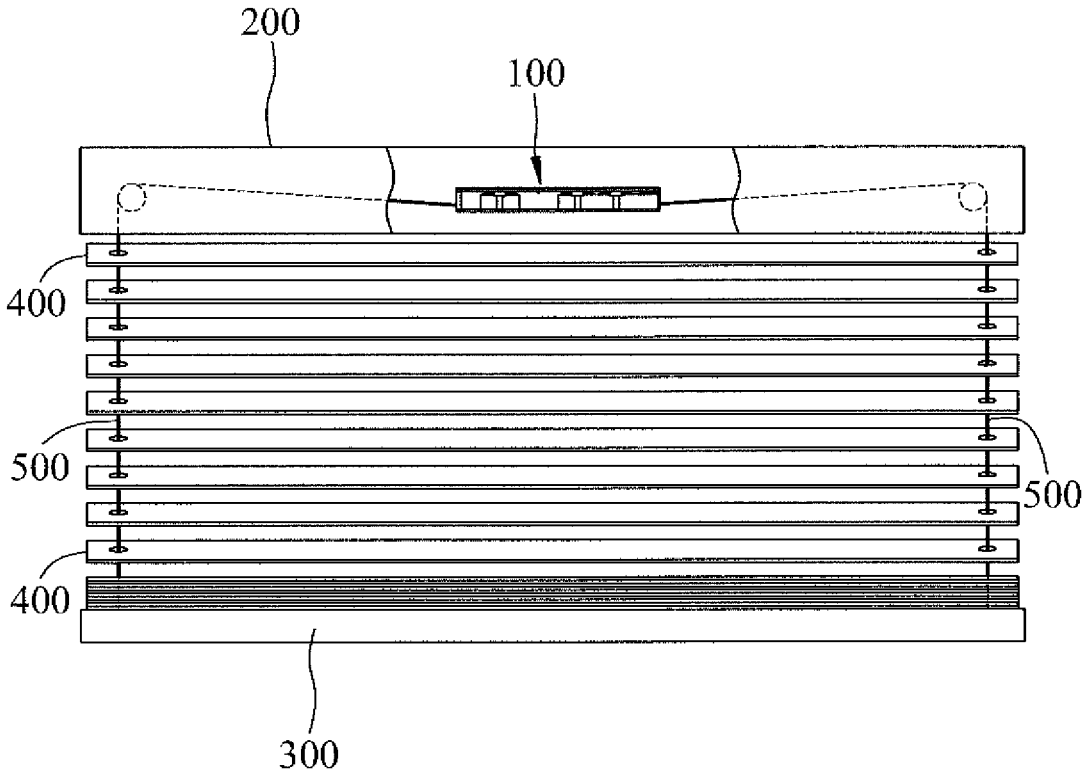
FIG. 3 is a schematic view of the first preferred embodiment of a cord-winding device for a Venetian blind according to this invention.

Referring to FIG. 3, the first preferred embodiment of a cord-winding device 100 according to this invention is mounted to a Venetian blind. The blind includes a head rail 200, a bottom rail 300, a plurality of slats 400, and two pull cords 500. Top ends of the pull cords 500 are connected to the cord-winding device 100. The pull cords 500 extend through the slats 400 to connect with the bottom rail 300. For convenience of illustration, a ladder string unit for hanging the slats 400 is not shown in FIG. 3.

Figure 4:
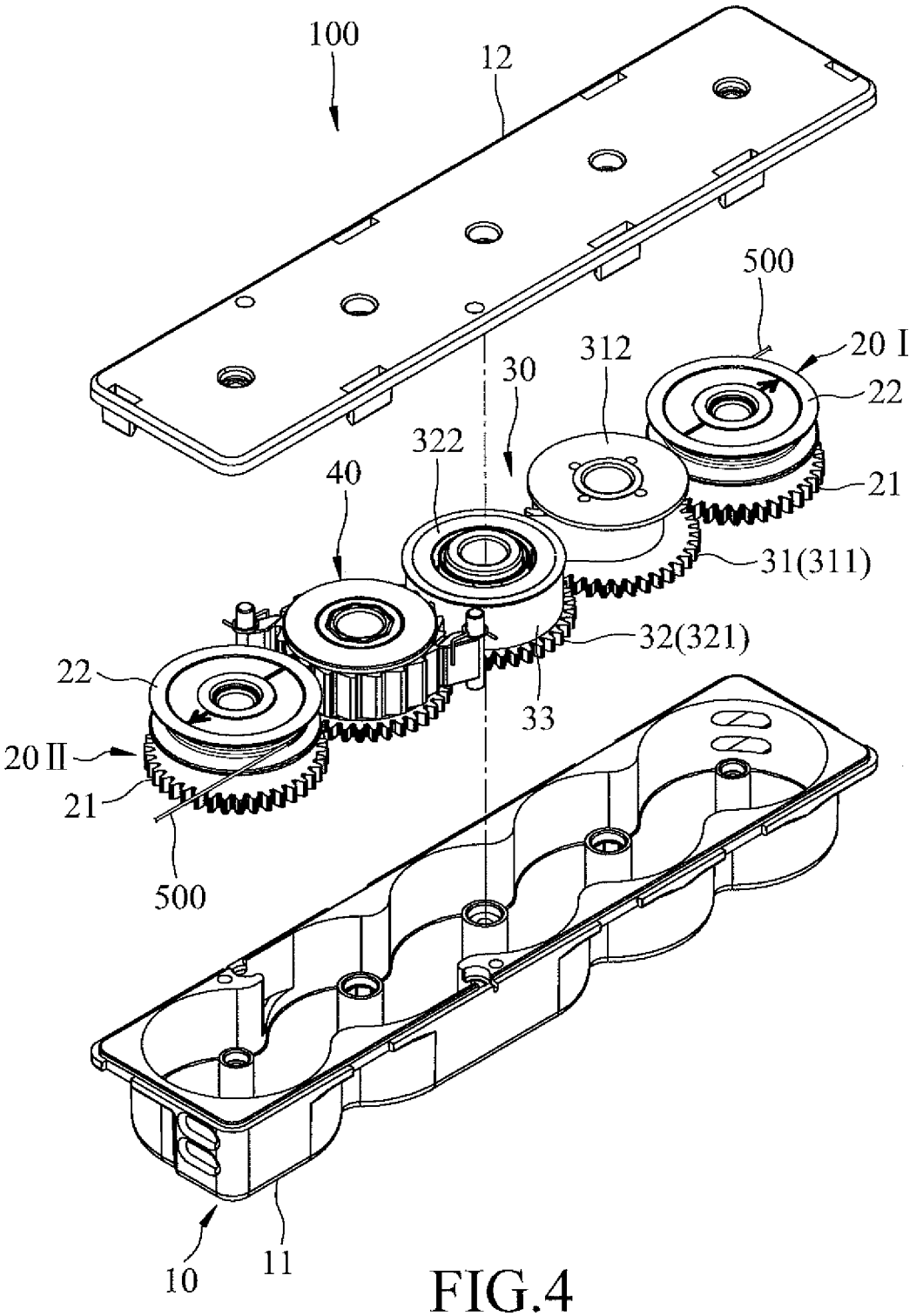
FIG. 4 is a partly exploded perspective view of the first preferred embodiment.

With additional reference to FIG. 4, the cord-winding device 100 includes a casing unit 10, a cord-winding unit, a first reel 201, a second reel 20II, a driving unit 30, and a brake unit 40.

The casing unit 10 includes a hollow bottom seat 11 and a top cover 12 disposed on the bottom seat 11.

Figure 6:
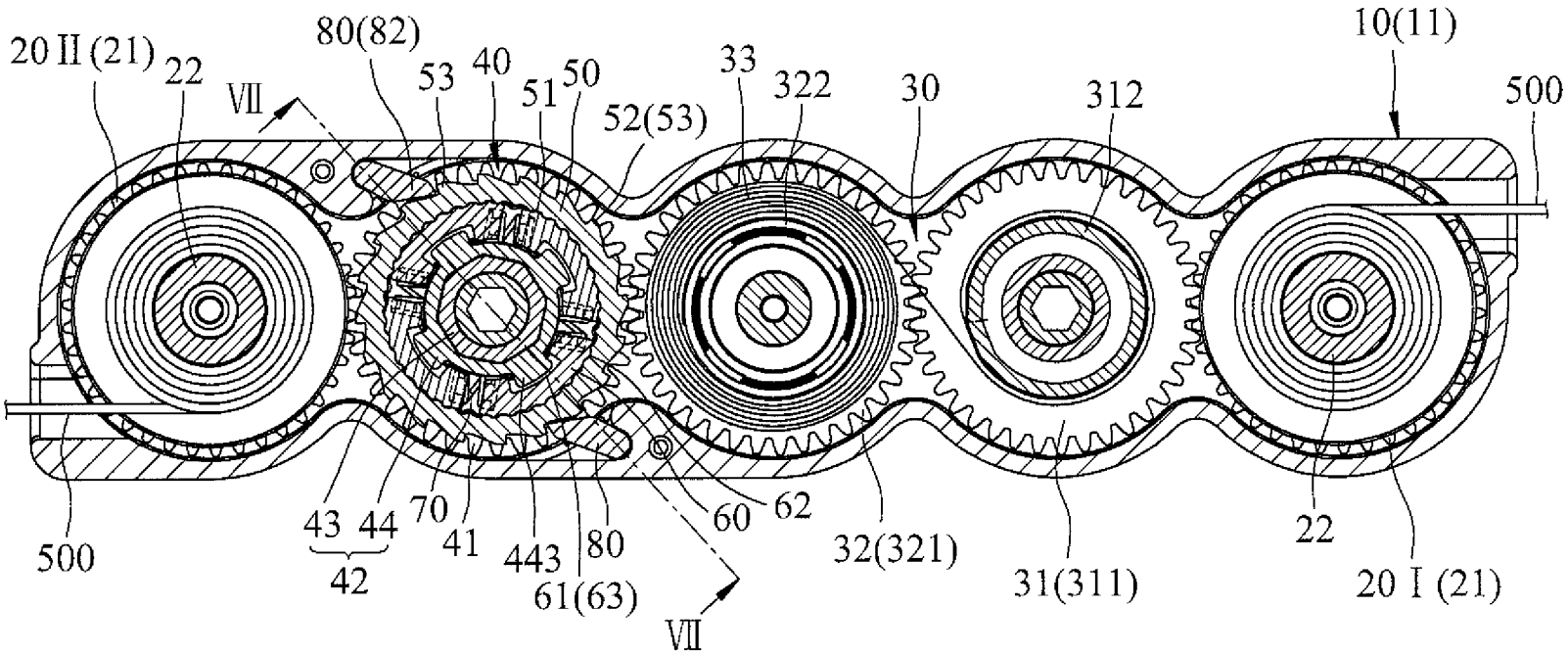
FIG. 6 is a sectional view of the preferred embodiment.

With further reference to FIG. 6, the cord-winding unit includes a first reel 201 and a second reel 20II. The first and second reels 20I, 20II are disposed rotatably in the casing unit 10. Each of the first and second reels 20I, 20II has a cord-winding gear 21, and a cord-receiving portion 22 disposed on the cord-winding gear 21. The top ends of the pull cords 500 are connected respectively to the cord-receiving portions 22 of the first and second reels 20I, 20II in such a manner that, when the bottom ends of the pull cords 55 are pulled downwardly to unwind the top ends of the pull cords 55 from the first and second reels 20I, 20II, the first and second reels 20I, 20II rotate in the same direction.

The driving unit 30 includes a driving wheel 31 disposed rotatably in the casing unit 10, a spring-winding wheel 32 disposed rotatably in the casing unit 10, and a spiral spring 33 connected between the driving wheel 31 and the spring-winding wheel 32. The driving wheel 31 has a driving gear 311, and a spring-receiving portion 312 disposed on the driving gear 311. The spring-winding wheel 32 has a spring-winding gear 321 meshing with the driving gear 311, and a spring-receiving portion 322 disposed on the spring-winding gear 321. In this embodiment, the cord-winding gear 21 of the first reel 201 meshes with the driving gear 311 of the driving wheel 31. The spiral spring 33 is fastened to the spring-receiving portion 312 at one end thereof, and is wound around the spring-receiving portion 322 at the other end thereof. When the spiral spring 33 is not subjected to any external force, a major portion thereof is wound around the spring-receiving portion 322.

Figure 5:
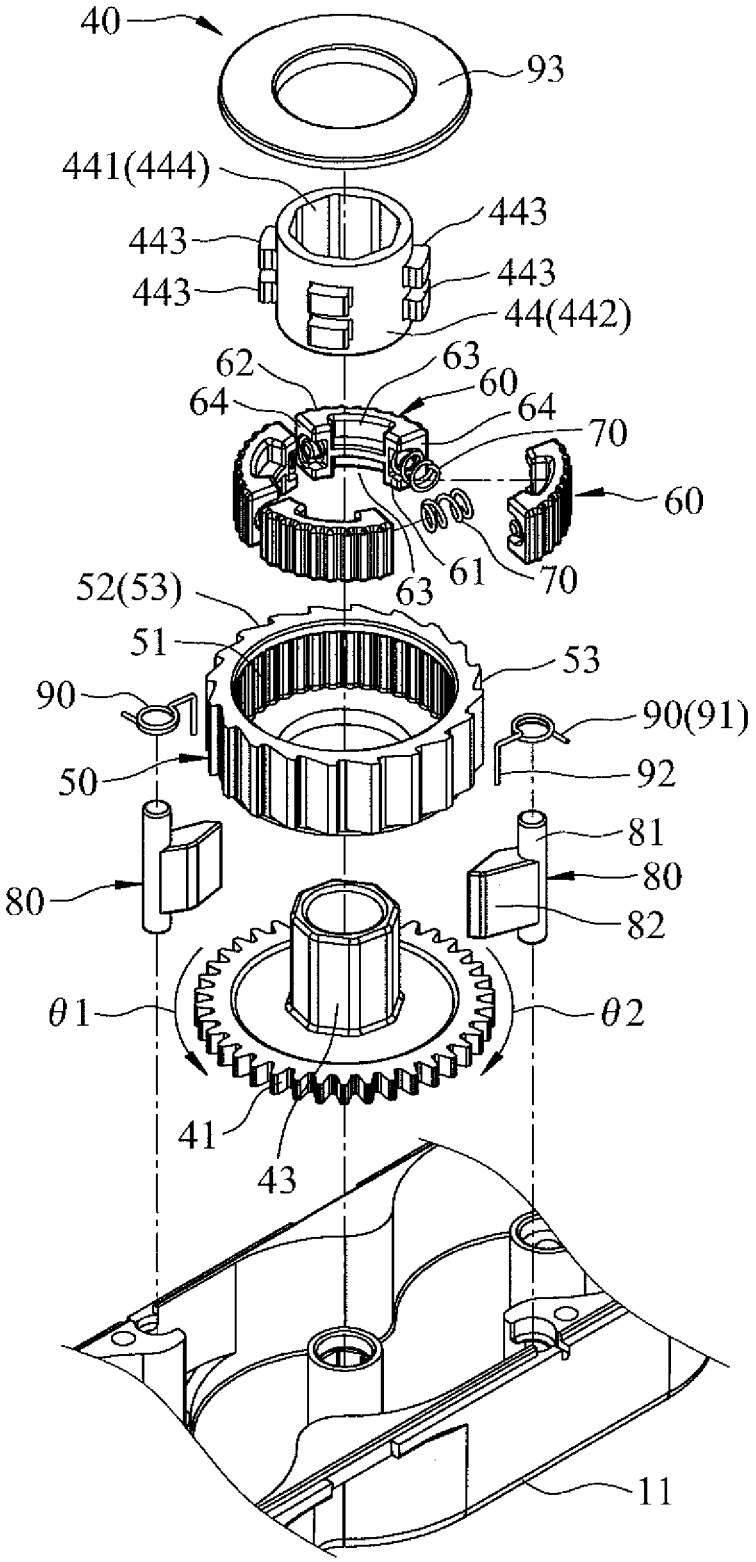
FIG. 5 is a partly exploded perspective view of a brake unit of the first preferred embodiment.
Figure 7:
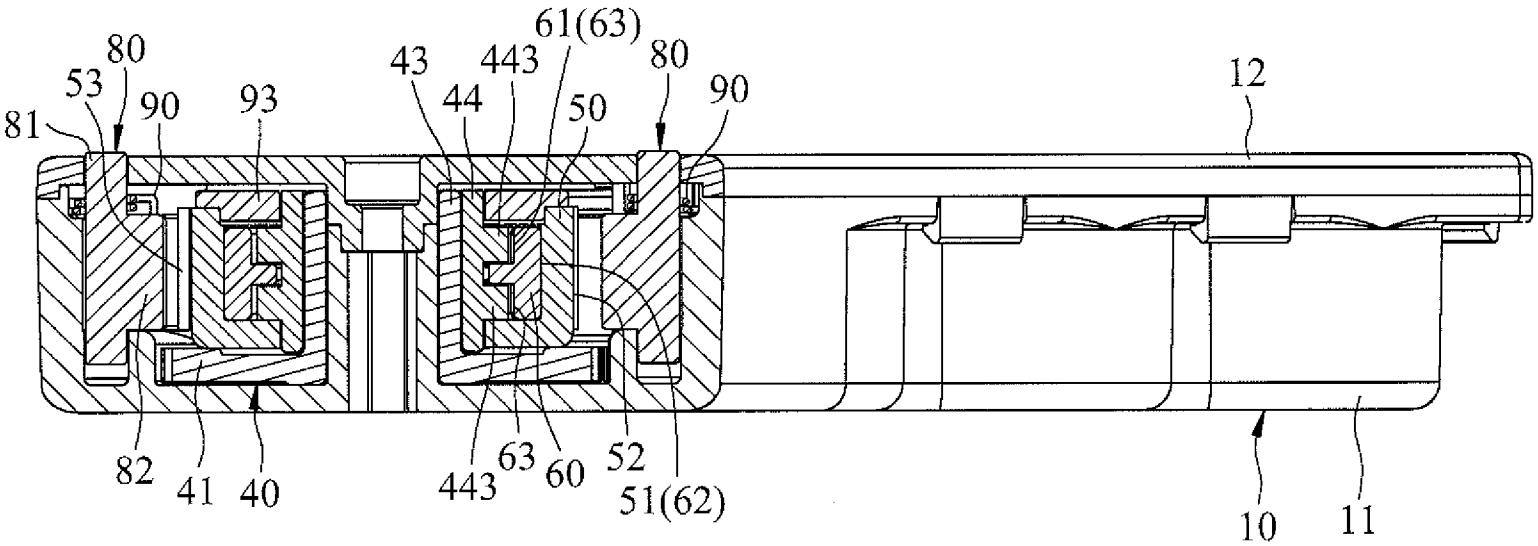
FIG. 7 is a sectional view taken along line VII-VII in FIG. 6.

With particular reference to FIGS. 5, 6, and 7, the brake unit 40 includes a driven gear 41 disposed rotatably in the bottom seat 11 of the casing unit 10, a driving member 42 disposed fixedly and coaxially on the driven gear 41, a ratchet wheel 50 sleeved on the driving member 42, a plurality of friction members 60 disposed between the driving member 42 and the ratchet wheel 50, a plurality of resilient members 70 each disposed between two adjacent friction members 60, two pawls 80 disposed in the casing unit 10 and engaging the ratchet wheel 50, two torsion springs 90, and an annular cover 93 disposed between the driving member 42 and a top end of the ratchet wheel 50. Alternatively, the brake unit 40 may include only one pawl 80.

The driven gear 41 meshes with the spring-winding gear 321. In this embodiment, the cord-winding gear 21 of the second reel 20II meshes with the driven gear 41.

The driven gear 41 can rotate in opposite first and second directions θ1, θ2. In this embodiment, the first direction θ1 is counterclockwise, and the second direction θ2 is clockwise.

The driving member 42 includes a shaft rod 43 that is disposed coaxially on the driven gear 41 and that is non-circular in cross-section, and a bushing 44 sleeved on the shaft rod 43. In this embodiment, the driving member 42 is formed integrally with the driven gear 41.

The bushing 44 receives fittingly the shaft rod 43, and has an inner peripheral surface 441 in intimate contact with the shaft rod 43, an outer peripheral surface 442, and a plurality of first engaging portions 443 disposed on the outer peripheral surface 442 and spaced apart from each other. In this embodiment, the first engaging portions 443 are configured as projections, and are arranged in four angularly equidistant pairs each arranged one above the other.

The ratchet wheel 50 includes a splined inner peripheral surface 51 formed with a plurality of spline grooves, an outer peripheral surface 52, and a plurality of ratchet teeth 53 disposed on the outer peripheral surface 52.

Each of the friction members 60 has an inner side surface 61, an outer side surface 62, two second engaging portions 63 each engaging the corresponding first engaging portion 443, and two end surfaces 64 connected between the inner and outer side surfaces 61, 62. In this embodiment, the outer peripheral surfaces 62 of the friction members 60 are toothed, and have teeth each engaging the corresponding spline groove in the inner peripheral surface 51 of the ratchet wheel 50. The second engaging portions 63 of the friction members 60 engage respectively the first engaging portions 443. It should be noted that, if a sufficient frictional force occurs between the ratchet wheel 50 and the friction members 60, the inner peripheral surfaces 51 of the ratchet wheel 50 and the outer side surfaces 62 of the friction members 60 will not have teeth.

The resilient members 70 bias the outer side surfaces 62 of the friction members 60 to contact the inner peripheral surface 51 of the ratchet wheel 50. In this embodiment, each of the resilient members 70 is disposed between the corresponding end surfaces 64 of the friction members 60, and is configured as a compression spring. As such, the friction members 60 are biased to contact intimately the ratchet wheel 50 by the resilient members 70, so as to create static frictional force therebetween, thereby transferring rotation of the driven gear 41 to the ratchet wheel 50. Otherwise, the resilient members 70 can be compressed to allow inward movement of the friction members 60 to thereby prevent synchronous rotation of the friction members 60 with the ratchet wheel 50, so as to prevent rotation of the ratchet wheel 50, while maintaining contact between the ratchet wheel 50 and the friction members 60.

Each of the pawls 80 has a shaft portion 81 disposed pivotally in the casing unit 10, and a finger portion 82 extending inwardly from the shaft portion 81.

Each of the torsion springs 90 is disposed between the casing unit 10 and the corresponding pawl 90, and is sleeved on the shaft portion 81 of the corresponding pawl 80. Each of the torsion springs 90 has a first end 91 inserted fixedly into a wall of the casing unit 10, and a second end 92 abutting against the corresponding pawl 90, so as to bias the finger portion 82 of the corresponding pawl 80 to contact the ratchet teeth 53 of the ratchet wheel 50. When the ratchet wheel 50 rotates in the first direction θ1, the finger portions 82 of the pawls 80 contact radially extending surfaces of the ratchet teeth 53 to prevent further rotation of the ratchet wheel 50 in the first direction θ1. Conversely, when the ratchet wheel 50 rotates in the second direction θ2, the finger portions 82 of the pawls 80 contact inclined surfaces of the ratchet teeth 53 to allow further rotation of the ratchet wheel 50 in the second direction θ2.

The annular cover 93 cooperates with the casing unit 10 to conceal the friction members 60 and the resilient members 70 therebetween.

With particular reference to FIGS. 3 and 6, during operation of the cord-winding device 100, to stop the bottom rail 300 at any desired height, it is necessary to satisfy the following two requirements:

1. In a situation where the slats 400 are fully opened, when no external force is applied thereto, the biasing force of the spiral spring 33 is not greater than the pulling force applied by the bottom rail 300 and the slats 400 to the pull cords 500; and 2. In a situation where the slats 400 are fully closed, when no external force is applied thereto, sum of the biasing force of the spiral spring 33 and static frictional force occurring between the ratchet wheel 50 and the friction members 60 is not less than the pulling force applied by the bottom rail 300 and the slats 400 to the pull cords 500.

Figure 8:
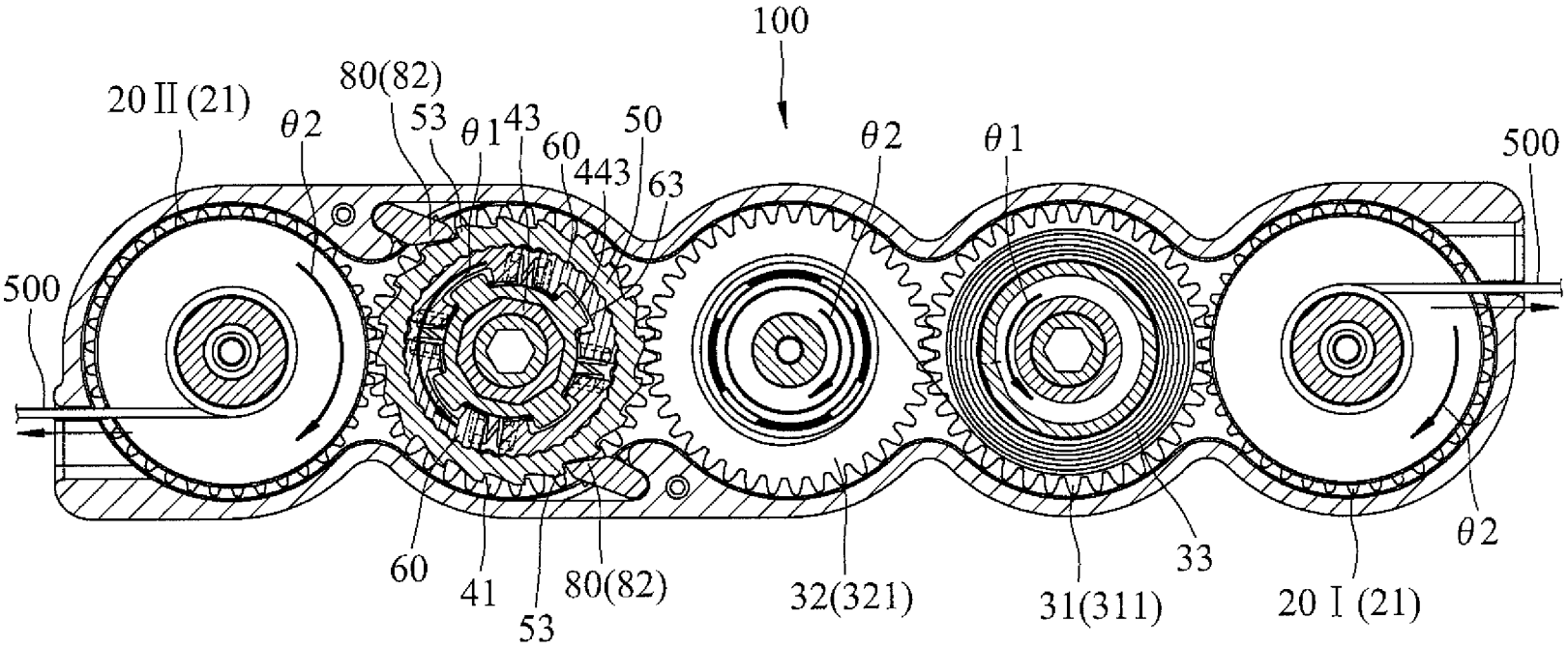
FIG. 8 is a view similar to FIG. 6 but illustrating that two pull cords are pulled outwardly to rotate a driven gear of the brake unit in a first direction.

With particular reference to FIGS. 3, 7, and 8, when it is desired to open the slats 400, a force is applied to pull the bottom rail 300 downwardly to thereby move the pull cords 500 outwardly, so as to allow the first and second reels 20I, 20II to have a tendency to rotate in the second direction θ2. Hence, the cord-winding gear 21 of the second reel 20II tends to drive the driven gear 41 to rotate in the first direction θ1. At this time, when the torque applied to the driven gear 41 is too small to overcome the frictional force occurring between the ratchet wheel 50 and the friction members 60, due to engagement between the finger portions 82 of the pawls 80 and the ratchet teeth 53, the ratchet wheel 50 cannot rotate. When the torque applied to the driven gear 41 is increased such that it is great enough to overcome the frictional force occurring between the ratchet wheel 50 and the friction members 60, due to engagement between the first engaging portions 443 of the driving member 42 and the second engaging portions 63 of the friction members 60, rotation of the friction members 60 relative to the ratchet wheel 50 is allowed. When the torque applied to the driven gear 41 is further increased such that it is great enough to overcome the biasing force of the spiral spring 33, the driven gear 41 drives rotation of the spring-winding gear 321 of the spring-winding wheel 32 in the second direction θ2, and the cord-winding gear 21 of the first reel 20I drives rotation of the driving gear 311 of the driving wheel 31 in the first direction θ1, so as to wind gradually the spiral spring 33 around the driving wheel 31. As soon as the bottom rail 300 is released, since no external force is applied, the bottom rail 300 and the slats 400 are stopped, such that the bottom rail 300 is stopped at a desired height.

Figure 9:
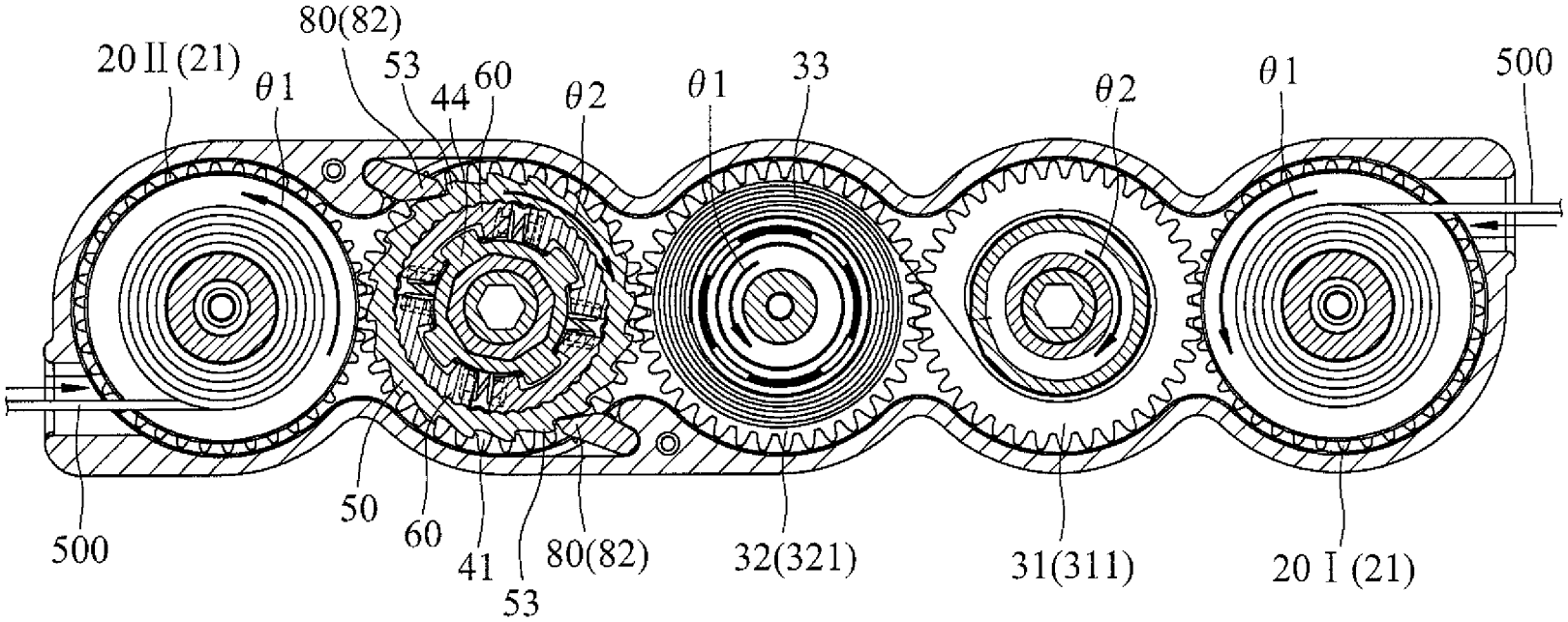
FIG. 9 is a view similar to FIG. 6 but illustrating that the pull cords are returned to their original positions to thereby rotate the driven gear of the brake unit in a second direction.

With particular reference to FIGS. 3, 7, and 9, when it is desired to close the slats 400, a force is applied to push the bottom rail 300 upwardly, so that the driving gear 311 of the driving wheel 31 is biased by the spiral spring 33 to rotate in the second direction θ2 to thereby rotate the spring-winding gear 321 of the spring-winding wheel 32 and the spring-winding gear 21 of the first reel 201 in the first direction θ1. At this time, the spiral spring 33 is wound gradually around the spring-winding wheel 32, and the driven gear 41 is driven by the spring-winding gear 321 of the spring-winding wheel 32 to rotate in the second direction θ2, thereby rotating the spring-winding gear 21 of the second reel 20II in the first direction θ1. At the same time, since the driven gear 41 rotates the driving member 42 to drive rotation of the friction members 60 and, thus, the ratchet wheel 50 in the second direction θ2, the ratchet teeth 53 can slide past the finger portions 82 of the pawls 80 (i.e., the pawls 80 cannot obstruct rotation of the ratchet wheel 50). Consequently, the first and second reels 20I, 20II are rotated to wind the pull cords 500 therearound. During this process, when the bottom rail 300 is released, since no external force is applied, the bottom rail 300 can be stopped at any desired position.

As such, the slats 400 can be opened or closed by moving the bottom rail 300 downwardly or upwardly, so that the cord-winding device 100 is convenient to operate. Furthermore, since the pull cords 500 are moved by synchronous rotation of the first and second reels 20I, 20II in the same direction, reclination of the bottom rail 300 can be prevented effectively.

Figure 10:
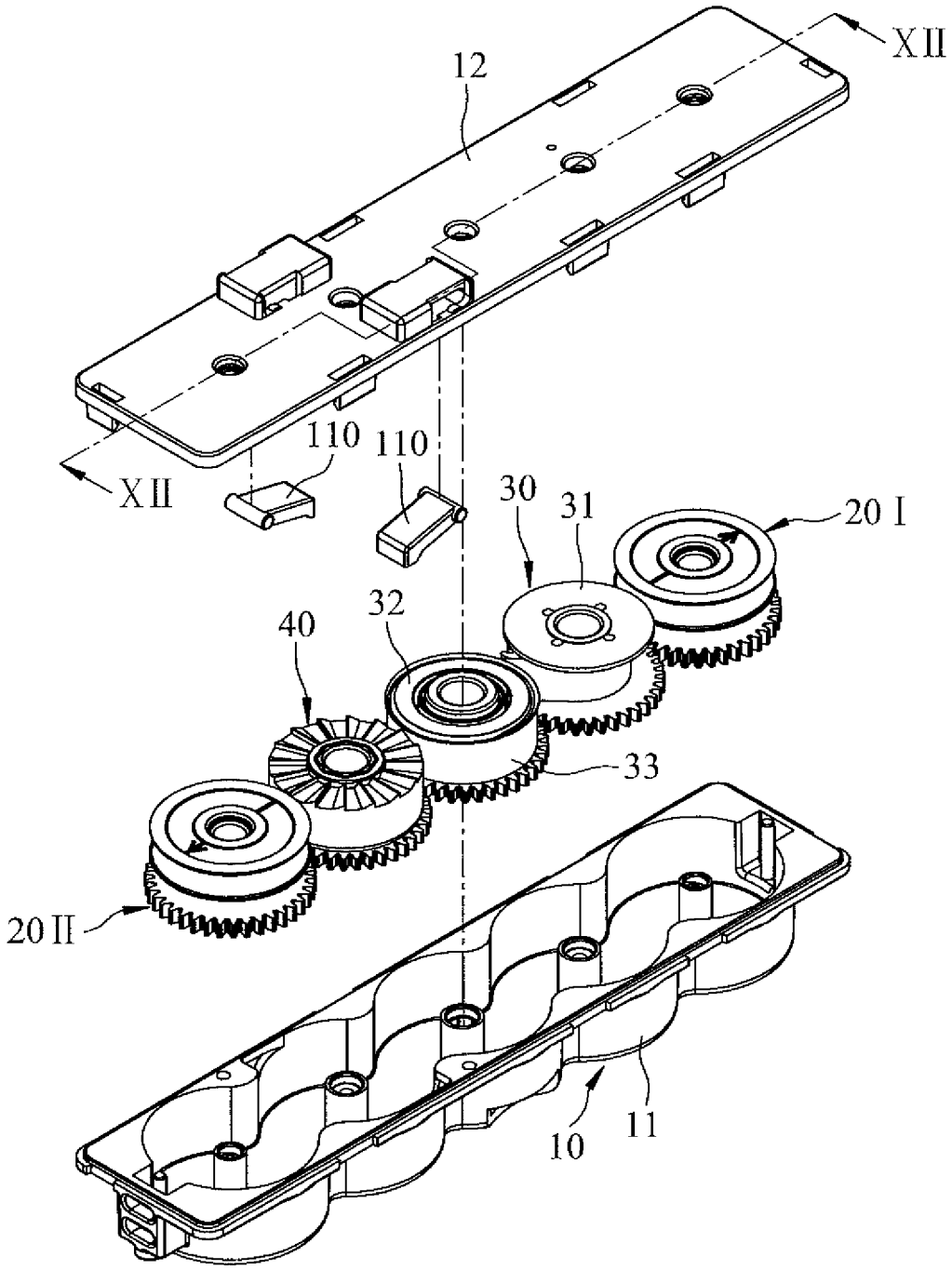
FIG. 10 is a partly exploded perspective view of the second preferred embodiment of a cord-winding device for a Venetian blind according to this invention.
Figure 11:
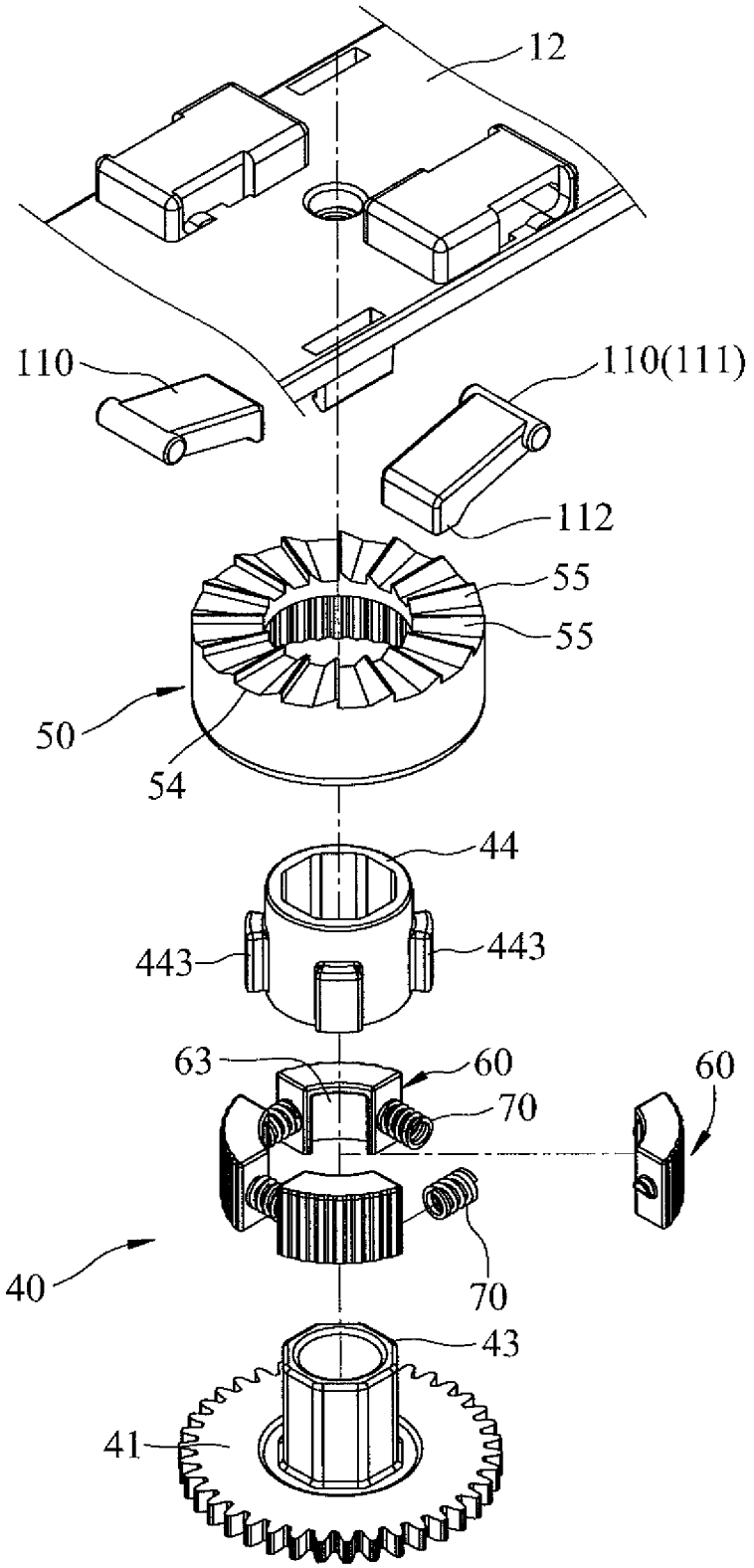
FIG. 11 is a partly exploded perspective view of a brake unit of the second preferred embodiment.
Figure 12:
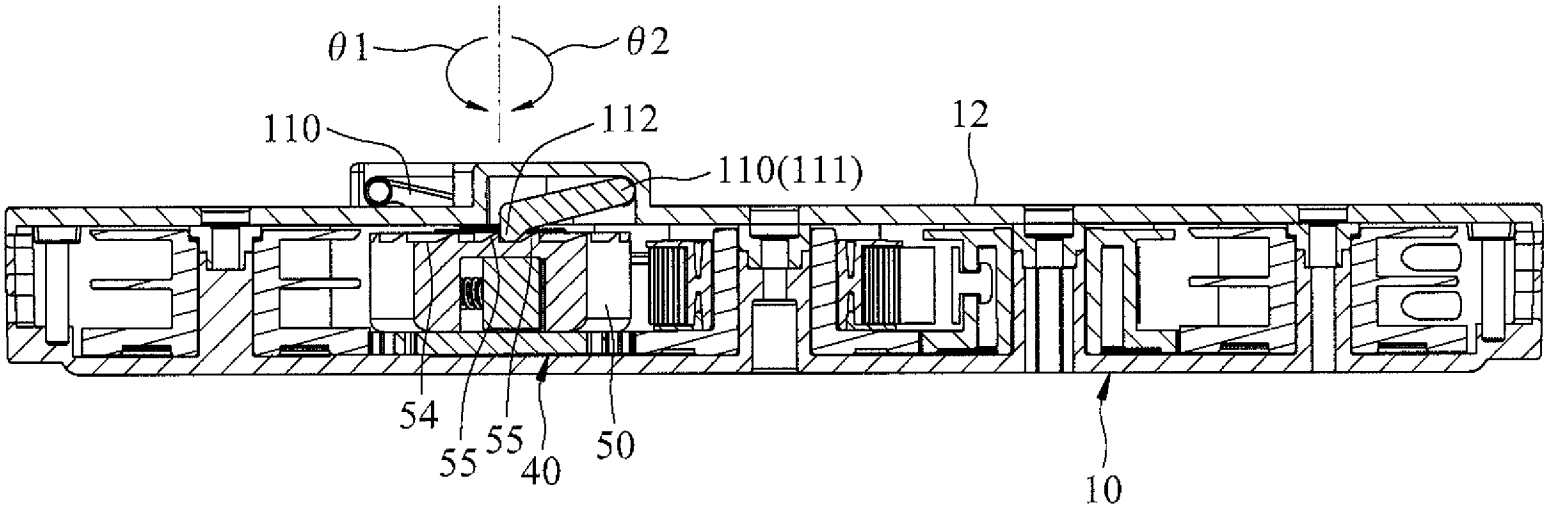
FIG. 12 is a sectional view taken along line XII-XII in FIG. 10.

FIGS. 10, 11, and 12 show the second preferred embodiment of a cord-winding device for a Venetian blind according to this invention, which differs from the first preferred embodiment in the following.

In this embodiment, the torsion springs 90 (see FIG. 5) and the annular cover 93 (see FIG. 5) are omitted from the brake unit 40, and the pawls 80 (see FIG. 5) are replaced with two modified pawls 110.

The bushing 44 of the driving member 42 has only a plurality of angularly equidistant first engaging portions 443.

Each of the friction members 60 has only a second engaging portion 63.

The ratchet wheel 50 has an annular top surface 54, and a plurality of ratchet teeth 55 disposed on the annular top surface 54 and spaced apart from each other.

Each of the pawls 110 has a pivotal portion 111 disposed pivotally on the top cover 12, and a finger portion 112 biased to engage the ratchet teeth 55 of the ratchet wheel 50. In this embodiment, the pawls 110 is biased to engage the ratchet teeth 55 with the fingers 112 by virtue of the gravity itself.

When the ratchet wheel 50 rotates in the first direction θ1, the fingers 112 of the pawls 110 contact radially extending surfaces of the ratchet teeth 55 to prevent rotation of the ratchet wheel 55. Conversely, when the ratchet wheel 50 rotates in the second direction θ2, the finger portions 112 of the pawls 110 contact inclined surfaces of the ratchet wheel 50, thereby allowing for rotation of the ratchet wheel 50.

As a consequence, the second preferred embodiment can achieve the same object and effect as the first preferred embodiment.

Figure 13:
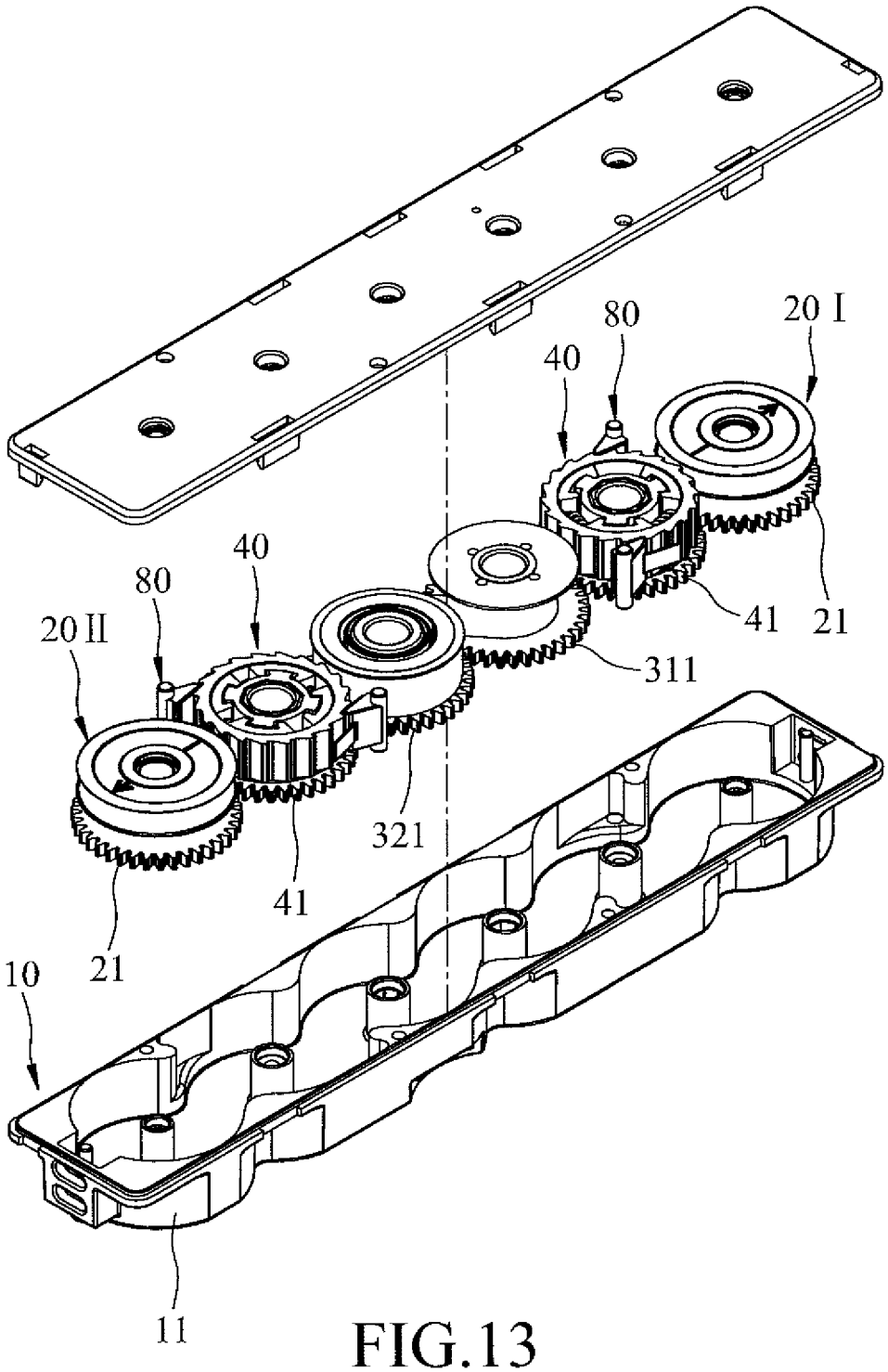
FIG. 13 is a partly exploded perspective view of the third preferred embodiment of a cord-winding device for a Venetian blind according to this invention.
Figure 14:
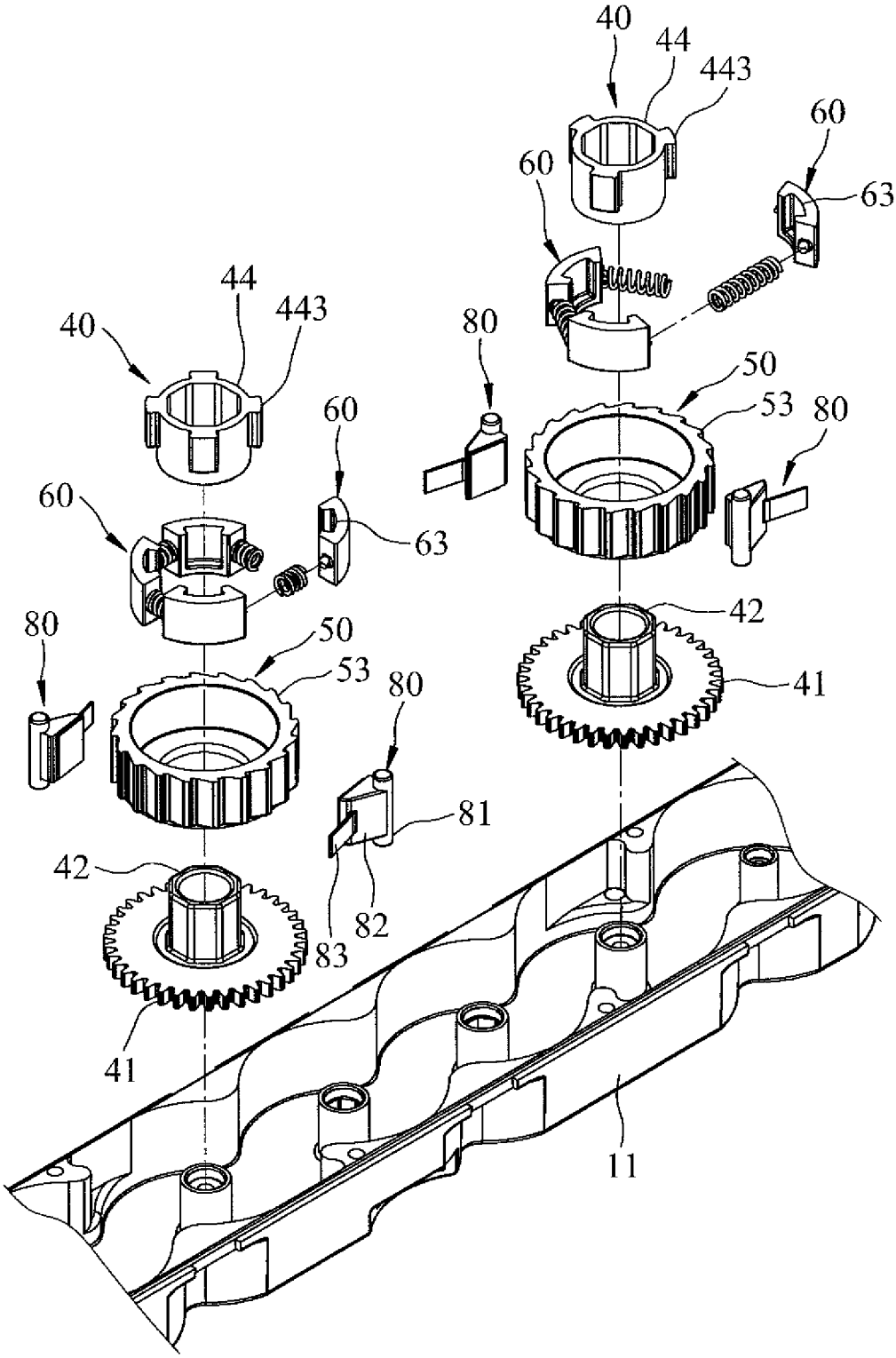
FIG. 14 is a fragmentary exploded perspective view of the third preferred embodiment.

Referring to FIGS. 13 and 14, the third preferred embodiment of a cord-winding device according to this invention differs from the first preferred embodiment in the following.

In this embodiment, the cord-winding device includes two brake units 40, and the torsion springs 90 (see FIG. 5) are omitted from the brake units 40.

The driven gear 41 of the right brake unit 40 is disposed between and meshes with the cord-winding gear 21 of the first reel 20I and the driving gear 311. The right brake unit 40 includes three friction members 60.

The driven gear 41 of the left brake unit 40 is disposed between and meshes with the cord-winding gear 21 of the second reel 20II and the spring-winding gear 321. The left brake unit 40 includes four friction members 60. The inclination directions of the ratchet wheels 50 of the brake units 40 are opposite to each other.

The bushing 44 of the driving member 42 of each of the brake units 40 has three angularly equidistant first engaging portions 443. Each of the friction members 60 has a second engaging portion 63 that engages the corresponding first engaging portion 443 of the corresponding bushing 44.

The pawl 80 of each of the brake units 40 has a shaft portion 81 disposed pivotally on the casing unit 10, a finger portion 82 extending from the shaft portion 81, and a spring plate 83 disposed on the finger portion 82 and abutting against an inner wall surface of the base 11 of the casing unit 10 for biasing the finger portion 82 to engage the ratchet teeth 53 of the ratchet wheel 50.

Figure 15:
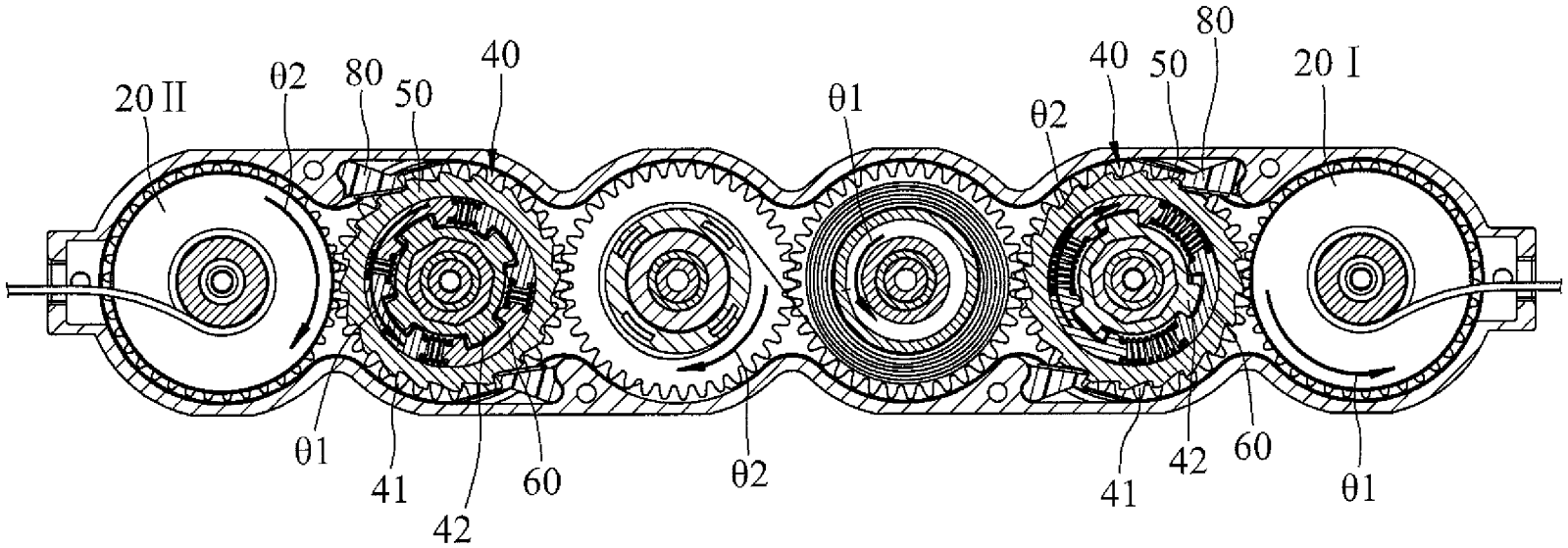
FIG. 15 is a sectional view of the third preferred embodiment, illustrating that the cord-winding gears of first and second reels are rotated in first and second directions, respectively.
Figure 16:
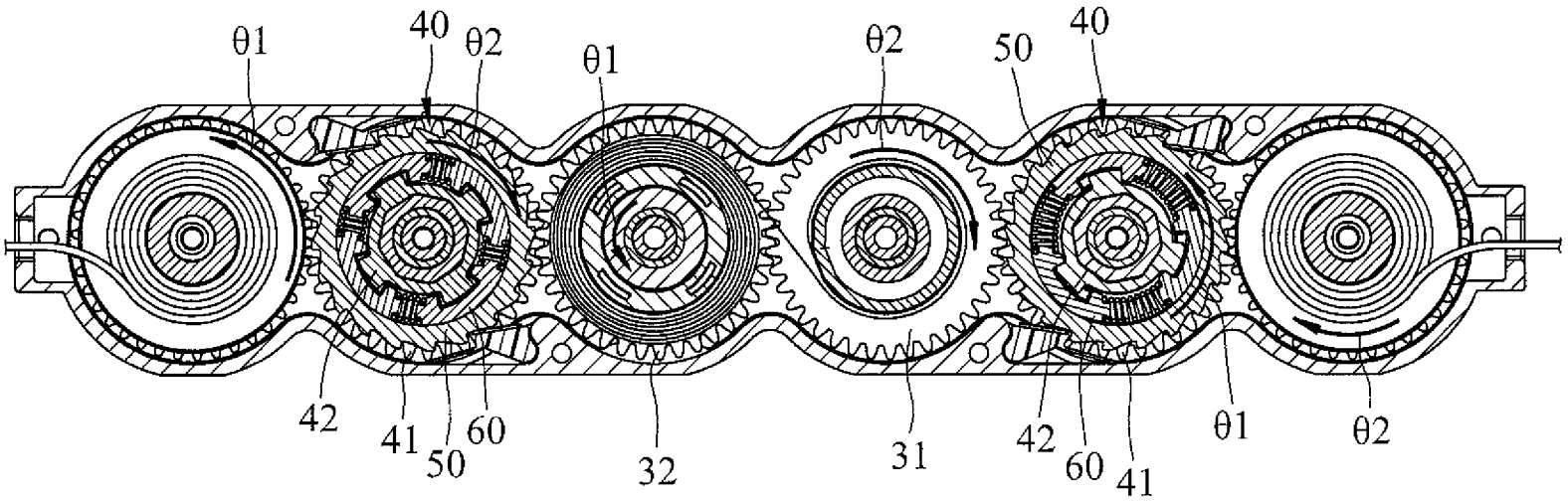
FIG. 16 is a sectional view of the third preferred embodiment, illustrating that the cord-winding gears of first and second reels are rotated in second and first directions, respectively.

As such, with particular reference to FIG. 15, when the first and second reels 20I, 20II drive the driven gears 41 of the brake units 40 to rotate in the second and first directions θ2, θ1, respectively, the pawls 80 stop rotation of the ratchet wheels 50, so that rotation of the friction members 60 relative to the ratchet wheels 50 is allowed. With particular reference to FIG. 16, when the driving wheel 31 and the spring-winding wheel 32 drive the driven gears 41 of the brake units 40 to rotate in the first and second directions θ1, θ2, respectively, the ratchets 50 are driven by the friction members 60 to rotate respectively and synchronously with the driving members 42. As a consequence, the third preferred embodiment can achieve the same object and effect as the first preferred embodiment.

With this invention thus explained, it is apparent that numerous modifications and variations can be made without departing from the scope and spirit of this invention. It is therefore intended that this invention be limited only as indicated by the appended claims.

I claim:

1. A cord-winding device adapted for use in a Venetian blind, comprising:

a casing unit;

a cord-winding unit disposed rotatably in said casing unit and provided with at least one cord-winding gear;

a driving unit including a driving wheel disposed rotatably in said casing unit and having a driving gear, a spring-winding wheel disposed rotatably in said casing unit and having a spring-winding gear, and a spiral spring connected between said spring-winding wheel and said driving wheel, said driving wheel meshing with said spring-winding wheel; and at least one brake unit including a driven gear disposed rotatably in said casing unit and meshing with said spring-winding gear, a driving member disposed coaxially on said driven gear, a ratchet wheel sleeved on said driving member, a plurality of friction members disposed between said driving member and said ratchet wheel, a plurality of resilient members each disposed between two adjacent ones of said friction members, and at least one pawl disposed on said casing unit and biased to engage said ratchet wheel, said driven gear meshing with said spring-winding gear of said driving unit, said cord-winding unit meshing with at least one of said driven gear and said driving gear of said driving unit, said driven gear being rotatable in a first direction or a second direction, each of said friction members being movable between said driving member and said ratchet wheel, said resilient members biasing said friction members into contact with said ratchet wheel such that, when said driven gear is driven by said cord-winding unit to rotate in one of said first and second directions, rotation of said ratchet wheel is stopped by said pawl so that said driving member drives said friction members to rotate, and when said driven gear is driven by said driving wheel to rotate in the other one of said first and second directions, said driving member drives rotation of said ratchet wheel via friction members.

2. The cord-winding device as claimed in claim 1, wherein:

said cord-winding unit includes a first reel provided with said cord-winding gear;

said driving wheel has a driving gear;

said spring-winding wheel has a spring-winding gear meshing with said driving gear;

said cord-winding gear meshes with one of said driven gear and said driving gear;

said driving member has a plurality of first engaging portions;

each of said friction members has at least one second engaging portion that engages a respective one of said first engaging portions;

when said driven gear is driven by said first reel to rotate in said first direction, rotation of said ratchet wheel is stopped by said pawl so that said driving member drives said friction members to rotate; and when said driven gear is driven by said driving wheel to rotate in said second direction, said driving member drives rotation of said ratchet wheel via said friction members.

3. The cord-winding device as claimed in claim 2, wherein said cord-winding unit further includes a second reel, said cord-winding gear of said first reel meshing with said driving gear of said driving wheel, said second reel being disposed rotatably in said casing unit and being provided with a cord-winding gear that meshes with said driven gear.

4. The cord-winding device as claimed in claim 3, wherein said driving member further has a shaft rod that is non-circular in cross-section and that is disposed coaxially on said driven gear, and a bushing sleeved on said shaft rod for receiving fittingly said shaft rod, said bushing having an outer peripheral surface, said first engaging portions being disposed on said outer peripheral surface of said bushing and being spaced apart from each other.

5. The cord-winding device as claimed in claim 4, wherein said first engaging portions are configured as projections, each of said friction members having opposite inner and outer side surfaces, said second engaging portions of said friction members being configured as grooves that are formed respectively in said inner side surfaces of said friction members.

6. The cord-winding device as claimed in claim 5, wherein said ratchet wheel has a splined inner peripheral surface formed with a plurality of spline grooves, said outer side surfaces of said friction members being toothed and having teeth each engaging a corresponding one of said spline grooves in said inner peripheral surface of said ratchet wheel.

7. The cord-winding device as claimed in claim 5, wherein each of said friction members further has two end surfaces connected between said inner and outer side surfaces, each of said resilient members being disposed between two corresponding ones of said end surfaces of said two adjacent ones of said friction members.

8. The cord-winding device as claimed in claim 3, wherein said driving unit further includes two torsion springs and two said pawls, said pawls being disposed pivotally on said casing unit, said ratchet wheel having an outer peripheral surface, and a plurality of ratchet teeth disposed on said outer peripheral surface of said ratchet wheel, said torsion springs being disposed between said housing unit and said pawls for biasing said pawls to engage said ratchet teeth of said ratchet wheel.

9. The cord-winding device as claimed in claim 8, wherein each of said pawls has a shaft portion disposed pivotally in said casing unit, and a finger portion disposed on said shaft portion, said torsion springs being sleeved respectively on said shaft portions, each of said torsion springs having a first end connected to said casing unit, and a second end abutting against said finger portions of a corresponding one of said pawls.

10. The cord-winding device as claimed in claim 8, wherein said brake unit further includes a cover that is configured as a ring plate and that is disposed between said driving member and a top end of said ratchet wheel for concealing said friction members and said resilient members thereamong.

11. The cord-winding device as claimed in claim 3, wherein said casing unit includes a hollow bottom seat and a top cover disposed on said bottom seat, said brake unit including two said pawls, said ratchet wheel having an annular top surface and a plurality of ratchet teeth disposed on said annular top surface and spaced apart from each other, each of said pawls having a pivotal portion disposed pivotally on said top cover, and a finger portion biased to engage said ratchet teeth of said ratchet wheel.

12. The cord-winding device as claimed in claim 1, wherein:

said cord-winding device comprises two said brake units;

said cord-winding unit includes a first cord-winding reel and a second cord-winding reel that are disposed in said casing unit, each of said first and second reels having one said cord-winding gear;

said driven gear of one of said brake units is disposed between and meshes with said cord-winding gear of said first reel and said driving gear, said driven gear of the other of said brake units is disposed between and meshes with said cord-winding gear of said second reel and said spring-winding gear;

said driving member of each of said brake units has a plurality of first engaging portions, said friction members of each of said brake units having at least one second engaging portion that engages a corresponding one of said first engaging portions; and when said first and second reels rotate said driven gears of said brake units in said second and first directions, respectively, said pawls of said brake units stop rotation of said ratchet wheel, so as to allow for rotation of said friction members relative to said ratchet wheels; and when said driving wheel and said spring-winding wheel rotate said driven gears of said brake units in said first and second directions, respectively, said ratchet wheels of said brake units are driven by said friction members of said brake units to rotate respectively and synchronously with said driving members.

13. The cord-winding device as claimed in claim 12, wherein each of said brake units includes two pawls, each of said pawls having a shaft portion disposed pivotally on said casing unit, a finger portion extending from said shaft portion, and a spring plate disposed on said finger portion and abutting against said casing unit, said ratchet wheel of each of said brake units having an outer peripheral surface, and a plurality of ratchet teeth disposed on said outer peripheral surface, said spring plate of each of said pawls of each of said brake units biasing said finger portion of said pawl to engage said ratchet teeth of said ratchet wheel of said brake units.

* * * * *